United States Patent [19]

Claar et al.

[11] 4,366,672

[45] Jan. 4, 1983

[54] PILOT OPERATED HYDRAULIC DEVICE

[75] Inventors: Leslie M. Claar, Painesville; John G. Russell, Highland Heights, both of Ohio

[73] Assignee: Parker-Hannifin Corporation, Cleveland, Ohio

[21] Appl. No.: 252,647

[22] Filed: Apr. 9, 1981

Related U.S. Application Data

[63] Continuation of Ser. No. 118,726, Feb. 2, 1979, abandoned.

[51] Int. Cl.[3] ..... F04B 1/26; F04B 49/00

[52] U.S. Cl. ..... 60/452; 417/222

[58] Field of Search ..... 417/218, 222; 60/445, 60/450, 452

[56] References Cited

U.S. PATENT DOCUMENTS

| | | | |
|---|---|---|---|
| 2,943,641 | 7/1960 | Arnold | 417/540 X |
| 3,171,352 | 3/1965 | Swift | 417/275 |
| 3,570,245 | 3/1971 | Van Der Linde | 60/413 |
| 3,601,504 | 8/1971 | McBurnett | 60/452 X |
| 3,774,505 | 11/1973 | McLeod | 91/506 |
| 3,784,327 | 1/1974 | Lonnemo | 417/222 |
| 3,941,513 | 3/1976 | Malott | 60/445 |
| 3,987,626 | 10/1976 | Bianchetta | 60/452 X |
| 3,995,425 | 12/1976 | Wittren | 60/452 X |
| 4,014,198 | 3/1977 | Herrmann | 60/413 X |
| 4,028,890 | 6/1977 | Habiger et al. | 60/445 X |
| 4,083,375 | 4/1978 | Johnson | 137/86 |

FOREIGN PATENT DOCUMENTS

| | | | |
|---|---|---|---|
| 1198624 | 7/1970 | United Kingdom | 417/222 |

OTHER PUBLICATIONS

"Stabilizing Networks for Hydraulic Motors" by Mannetie, *Control Engineering*, Jun. 1974, pp. 55–58.

*Primary Examiner*—Carlton R. Croyle
*Assistant Examiner*—Edward Look
*Attorney, Agent, or Firm*—James A. Baker

[57] ABSTRACT

A fluid pressure system includes a variable displacement pump and a control spool. The control spool has one end face exposed to pressure in a control chamber and another end face exposed to pump outlet pressure to increase or decrease the displacement of the pump. The control chamber includes a pilot valve which regulates the maximum pressure in the control chamber. A resistance means and a capacitance means is connected to the control chamber in parallel with the pilot valve to make the control spool responsive to the rate of change of pump outlet pressure.

6 Claims, 1 Drawing Figure

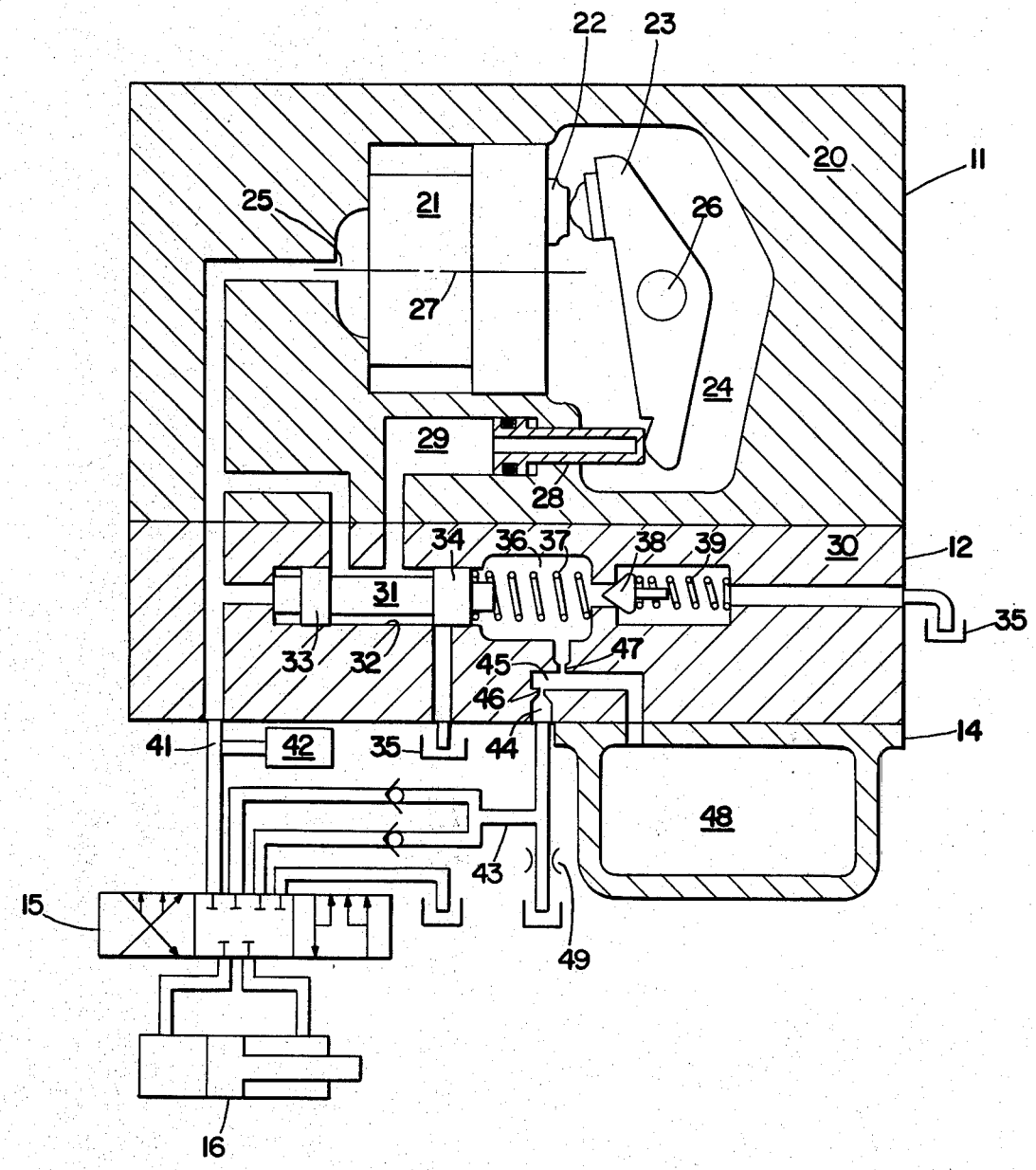
22
23
20
11
25
21
26
27
24
29
28
34
36
37
38
39
30
12
31
35
33
32
45
47
46
44
41
42
35
14
48
43
15
49
16

PILOT OPERATED HYDRAULIC DEVICE

This is a continuation of application Ser. No. 118,726, filed Feb. 2, 1979, now abandoned.

BACKGROUND OF THE INVENTION

The present invention relates generally to pilot operated hydraulic devices. More particularly, the invention relates to pilot operated variable displacement hydraulic pumps in which the displacement of the pump can be changed to match the requirements of the system in which the pump is used.

Variable displacement pumps are well known in the art, such as shown in U.S. Pat. Nos. 3,941,513 and 3,774,505, both of which are incorporated herein by reference. These pumps include a flow generating means and an actuator responsive to pump outlet pressure to change the displacement of the flow generating means.

SUMMARY OF THE INVENTION

The present invention provides a variable displacement pump and a system in which the displacement of the pump is changed in response to pump outlet pressure and in response to the rate of change of the pump outlet pressure.

According to the principles of the invention, this is accomplished by providing a pump having a flow generating means and an actuator for changing the displacement of the flow generating means in response to fluid pressure supplied to the actuator.

A control spool controls the fluid pressure supplied to the actuator. One end of the control spool is hydraulically connected to the pump outlet port to urge the control spool in a direction to decrease the displacement of the pump. The other end of the control spool is exposed to the fluid pressure in a control chamber to urge the control spool in a direction to increase the displacement of the pump.

The pressure in the control chamber is determined by the load demand pressure of the system and by a pilot valve. The pilot valve limits the maximum control chamber present by hydraulically connecting the control chamber to reservoir when the control chamber pressure exceeds a predetermined pressure. The load demand pressure is communicated to the control chamber by a feedback passage.

A first orifice is placed in the feedback passage between the load and the control chamber, and a capacitor chamber is connected to the feedback line between the first orifice and the control chamber. A second orifice of a size substantially larger than the first orifice is placed in the feedback passage between the capacitor chamber and the control chamber.

By this arrangement, the control spool, and hence the actuator, is responsive to pump outlet pressure and to the rate of change of the pump outlet pressure. Thus, when there is a sudden decrease in load flow demand (or increase in pressure) in the system, the displacement of the pump begins to decrease before the pilot valve opens. This is because the sudden increase in pump outlet pressure acts instantaneously against the one end of the control spool to urge the control spool in a direction to decrease the displacement of the pump. Transmission of this sudden increase in pressure to the control chamber, however, is delayed by the action of the orifices and capacitor chamber.

BRIEF DESCRIPTION OF THE DRAWING

These and other features and advantages of the invention are embodied in the pump and system shown in the accompanying drawing, wherein a pump and system according to the invention are illustrated in a cross-sectional side elevational view.

DETAILED DESCRIPTION OF THE DRAWING

Referring now to the drawing in greater detail, a hydraulic circuit includes a variable displacement pump 11, a control valve 12, a capacitance means 14, a selector valve 15, and a load motor 16.

The variable displacement pump 11 is of a well known axial piston type and includes a housing 20, a cylinder or barrel 21 rotatably journaled in the housing 20, a plurality of axially reciprocating pistons 22 (only one of which is shown), and a swashplate 23. In a well known manner, rotation of the barrel 21 causes the pistons 22 to reciprocate and pump fluid from a low pressure area 24 to a pump outlet port 25.

The rotational axis 26 of the swashplate 23 is offset from the rotational axis 27 of the barrel 21, so that the swashplate 23 is normally biased to a minimum pump displacement position (not shown). An actuator 28 acts against the lower end of the swashplate 23 to increase the displacement of the pump when fluid pressure is supplied to an actuator chamber 29.

The control valve 12 controls the fluid pressure supplied to the actuator chamber 29. The control valve 12 includes a housing 30 which is bolted to the housing 20. A control spool 31 is slidably disposed in an axial bore 32 in the housing 30. The control spool 31 includes a first land 33 for controlling fluid pressure communication between the pump outlet port 25 and the actuator chamber 29. The control spool 31 also includes a second land 34 for controlling fluid pressure communication between the actuator chamber 29 and a reservoir 35.

The entire left end face of the control spool 31 is exposed to the fluid pressure in the pump outlet port 25. In this manner, the pump outlet pressure urges the control spool 31 to the right to interrupt fluid pressure communication between the pump outlet 25 and the actuator chamber 29 and to open fluid pressure communication between the actuator chamber 29 and the reservoir 35.

The control valve 12 also includes a control chamber 36, and the entire right end face of the control spool 31 is exposed to fluid pressure in the control chamber 36. In this manner, the control chamber pressure urges the control spool 31 to the left to interrupt fluid pressure communication between the actuator chamber 29 and the drain 35 and to open fluid pressure communication between the pump outlet 25 and the actuator chamber 29. A coil spring 37 in the control chamber 36 also acts against the control spool 31 to urge the control spool 31 to the left.

The maximum pressure in the control chamber 36 is limited by a pilot valve 38 which selectively connects the chamber 38 to the reservoir 35. The pilot valve 38 is spring biased to the closed position shown in the drawing by a spring 39. By this arrangement, the pilot valve 38 remains closed until the pressure in the control chamber 36 reaches a predetermined pressure sufficient to overcome the preload of the spring 39.

A metal line 41 hydraulically connects the pump outlet port 25 with the selector valve 15. A large capacitor chamber 42 is hydraulically connected to the line 41 in a well known manner to reduce the magnitude of the pressure ripples in the pump outlet 25 when the selector valve 15 is in its neutral or centered position. The selector valve 15 is a closed center directional control valve for selectively supplying fluid pressure from the line 41 to either side of the load motor 16 and for connecting the other side of the load motor 16 to the reservoir 35. Alternatively, the selector valve 15 and the load motor 16 can be replaced by any other suitable load circuit. A metal line 43 connects the highest load demand pressure in the load circuit to a feedback port 44.

A passage 45 hydraulically connects the feedback port 44 to the control chamber 45. A first orifice 46 and a second orifice 47 are arranged in series in the passage 45, and the second orifice 47 is significantly larger than the first orifice 46.

The capacitance means 14 includes a large capacitor chamber 48 which is filled with the working fluid for the system. The capacitor chamber 48 is arranged in parallel with the pilot valve 38 and is connected between the first orifice 46 and the second orifice 47.

In the preferred embodiment, the pump 11 has a maximum displacement of two cubic inches per revolution. The volume of the pump capacitor chamber 42 is approximately 100 cubic inches, and the remaining fluid volume on the load side of the system when the valve 15 is in its neutral position is insignificant. The capacitor chamber 48 has a volume of at least 8 cubic inches and preferably 16 cubic inches, and the remaining fluid volume on the control side of the system is insignificant. The orifice 47 is .043 inches in diameter, and the orifice 46 is 0.029 inches in diameter.

When the directional control valve 15 is in its neutral position, the feedback line 43 is connected to the reservoir 35 through a very small orifice 49, and the pump 11 is in its minimum displacement position. When the directional control valve 15 is displaced from its neutral position, the feedback line 43 and the pump outlet 25 are both hydraulically connected to the working chamber of the load motor 16.

Under these conditions, the outlet pressure of the pump 25 moves the spool 31 to the right from its neutral position shown in the drawing, and the pressure in the control chamber 36 and the spring 37 balance this force to satisfy the following equation:

$$P_{out}A = P_{con}A + F_s$$

where $P_{out}$ is the outlet pressure of the pump 11, $P_{con}$ is the pressure in the control chamber 36, A is the cross sectional area of the spool 31, and $F_s$ is the force of the spring 37.

When there is a sudden decrease of fluid flow in the system to the load motor 16, such as would occur when the valve 15 is suddenly moved to its neutral position or when the load motor 16 reaches the end of its stroke, the pressure in the pump outlet 25 begins to increase very rapidly. Under these conditions, the present invention provides a means to destroke the pump 11 before the pilot valve 38 opens. Thus, when the pressure in the pump outlet 25 increases suddenly, the increased pressure is not immediately communicated to the control chamber 36. Instead, the small orifice 46 and the capacitor chamber 48 delay this pressure increase in the chamber 36. This creates an immediate pressure differential across the control spool 31 so that the control spool 31 begins moving to the right to isolate the actuator chamber 29 from the pump outlet 25 and to connect the actuator chamber 29 to the drain 35 to destroke the pump 11. In this manner, the destroking of the pump 11 does not have to wait until the outlet pressure of the pump is sufficient to open the pilot valve 38. Instead, the destroking begins to occur when the rate of change of the pump outlet pressure exceeds a predetermined rise rate.

The orifice 47 reduces back and forth movement of the control spool 31 in response to pressure ripples in the pump outlet 25. Thus, the orifice 47 partially ioslates the control chamber 36 from the capacitor chamber 48 so that pressure ripples in the pump outlet 25 do not cause undesirable movement of the control spool 31.

Although a specific embodiment of the invention has been shown and described above, the optimum sizes for the capacitor chamber 48 and for the orifices 46 and 47 may be determined by experimentation for a particular system. Thus, if it is desired to decrease the critical rate of change of pressure in the pump outlet 25 necessary to cause destroking of the pump 11, the orifice 47 may be made smaller or the capacitor chamber 48 may be made larger. Similarly, if it is desired to reduce movement of the control spool 31 caused by pressure ripples in the pump outlet 25, the orifice 48 may also be made smaller.

What is claimed is:

1. A variable hydraulic displacement pump adapted for responding quickly to rapid pump outlet pressure increases comprising a variable displacement flow generating means, an outlet port hydraulically connected to said flow generating means, single actuator means responsive to the rate of change of pressure in said outlet port for changing the fluid displacement rate of said flow generating means, said responsive means including an actuator, a control spool having means for increasing and decreasing fluid pressure acting against said actuator, a first area on said control spool exposed to pressure in said outlet port for moving said control spool in one direction, a control chamber, a second area on said control spool exposed to pressure in said control chamber for moving said control spool in the other direction, a pilot valve hydraulically connected to said control chamber, resistance means and capacitance

2. A pump according to claim 1 wherein the lateral cross sectional area of said first mentioned orifice is smaller than the lateral cross sectional area of said other orifice.

3. A pump according to claim 1 wherein the lateral cross sectional area of said first mentioned orifice is less than two thirds the lateral cross sectional area of said other orifice.

4. A pump according to claim 1 wherein said capacitance means includes a capacitor chamber, and the volume of said capacitor chamber is at least about 8 cubic inches.

5. A pump according to claim 1 wherein said capacitance means includes a capacitor chamber, and the volume of said capacitor chamber is at least about 16 cubic inches.

6. A hydraulic system adapted for responding quickly to rapid pump outlet pressure increases comprising a variable volume flow generating means, an outlet port, a selector valve, a load motor, means hydraulically connecting said flow generating means and said outlet port and said selector valve and said load motor, actuator means for changing the fluid displacement rate of said flow generating means, a control spool having valve means for increasing and decreasing fluid pressure acting against said fluid actuator means, a first area on said control spool exposed to pressure in said outlet port for moving said control spool in one direction, a control chamber, a second area on said control spool exposed to pressure in said control chamber for moving said control spool in the other direction, a feedback port in communication with said load motor, passage means hydraulically connecting said feedback port and said control chamber, means for delaying transmission of a sudden increase in fluid pressure in said outlet port to said control chamber, said delaying means including capacitance means and resistance means arranged in series in said passage means, said capacitance means being a fixed volume chamber, and a pivot valve hydraulically connected to said control chamber with said pilot valve being in parallel with said capacitance means and said resistance means.

* * * * *

UNITED STATES PATENT AND TRADEMARK OFFICE

CERTIFICATE OF CORRECTION

PATENT NO. : 4,366,672

DATED : January 4, 1983

INVENTOR(S) : Leslie M. Claar and John G. Russell

It is certified that error appears in the above-identified patent and that said Letters Patent are hereby corrected as shown below:

In column 4, line 41, after "capacitance" add---means hydraulically connected to said control chamber in parallel with said pilot valve, said capacitance means being a fixed volume chamber having a volume substantially larger than the volume of the control chamber, a feedback port adapted to be hydraulically connected to a load passage means hydraulically connecting said feedback port and said control chamber, said resistance means including an orifice in said passage means, said capacitance means being hydraulically connected to said passage means between said orifice and said control chamber, and another orifice in said passage means in series with said first mentioned orifice, and said other orifice being between said capacitance means and said control chamber,---

In column 6, line 4, change "pivot" to---pilot---

Signed and Sealed this

First Day of March 1983

[SEAL]

*Attest:*

GERALD J. MOSSINGHOFF

*Attesting Officer* *Commissioner of Patents and Trademarks*